US005971119A

United States Patent [19]

Chi

[11] Patent Number: 5,971,119

[45] Date of Patent: Oct. 26, 1999

[54] LUGGAGE CASE

[76] Inventor: Chen Lung Chi, P.O. Box 82-144, Taipei, Taiwan

[21] Appl. No.: 08/912,163

[22] Filed: Aug. 15, 1997

[51] Int. Cl.[6] ..... A45C 3/00

[52] U.S. Cl. ..... 190/108; 190/102; 190/110; 24/625; 24/683

[58] Field of Search ..... 24/625, 573.1, 24/683, 628; 190/102, 110; 150/111

[56] References Cited

U.S. PATENT DOCUMENTS

| | | | |
|---|---|---|---|
| 4,424,841 | 1/1984 | Smith | 190/102 X |
| 4,672,725 | 6/1987 | Kasai | 24/625 |
| 5,291,641 | 3/1994 | Morino | 24/625 |
| 5,383,257 | 1/1995 | Krauss | 24/625 |
| 5,542,161 | 8/1996 | Anscher | 24/573.1 |
| 5,547,052 | 8/1996 | Latshaw | 190/102 X |

*Primary Examiner*—Gary E. Elkins
*Assistant Examiner*—Tri M. Mai
*Attorney, Agent, or Firm*—A & J

[57] ABSTRACT

A luggage case includes a primary case provided with a plurality of male fasteners each including a base and a plug, the base being riveted on the primary case and having a passage going through the primary case, and a secondary case provided with a plurality of female fasteners riveted on the secondary case, each of the female fasteners having a recess adapted to receive the plug, a neck portion having two holes at two opposite sides thereof, and two positioning arms at the two opposite sides thereof each having a protuberance engageable with the holes of the neck portion, whereby the secondary case can be easily engaged or disengaged from the primary case.

4 Claims, 6 Drawing Sheets

LUGGAGE CASE

BACKGROUND OF THE INVENTION

1. Field of the Invention

This invention is related to a luggage case and in particular to one which consists of a primary case and a detachable secondary case.

2. Description of the Prior Art

Recently, there is desire for a luggage case consisting of a primary case and a detachable secondary case so that the two cases can be used separately as desired. U.S. Pat. No. 5,240,106 discloses utilizing adhesive straps 59*a* and 60*a* and connectors 55*a* and 56*a* to connect two cases together. Nevertheless, for those using zipper means as connectors to engage the primary case with the secondary cases, the user must pull the zipper head around the whole case in order to engage or disengage the secondary case from the primary case thereby causing much inconvenience in use. Although adhesive straps are convenient to use, they cannot provide sufficient support for the engagement between the secondary case and the primary case especially when the secondardy case contains a heavy article such as, for example, a notebook computer or the like.

Therefore, it is an object of the present invention to provide a luggage case which can obviate and mitigate the above-mentioned drawbacks.

SUMMARY OF THE INVENTION

This invention is related to a luggage case and in particular to one which consists of a primary case and a detachable secondary case.

It is the primary object of the present invention to provide a luggage case having a primary case and a secondary case which can be easily and rapidly engaged or disengaged from the primary case.

It is another object of the present invention to provide a luggage case of which the fasteners are easy to use.

It is still another object of the present invention to provide a luggage case consisting of a primary case and a detachable secondary case which can be firmly engaged with the primary case.

It is still another object of the present invention to provide a luggage case which is simple in construction.

It is a further object of the present invention to provide a luggage case which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numberals refer to identical or similar parts.

DETAILED DESCRIPTION OF THE PREFERRED EMBODIMENT

Figure 1:
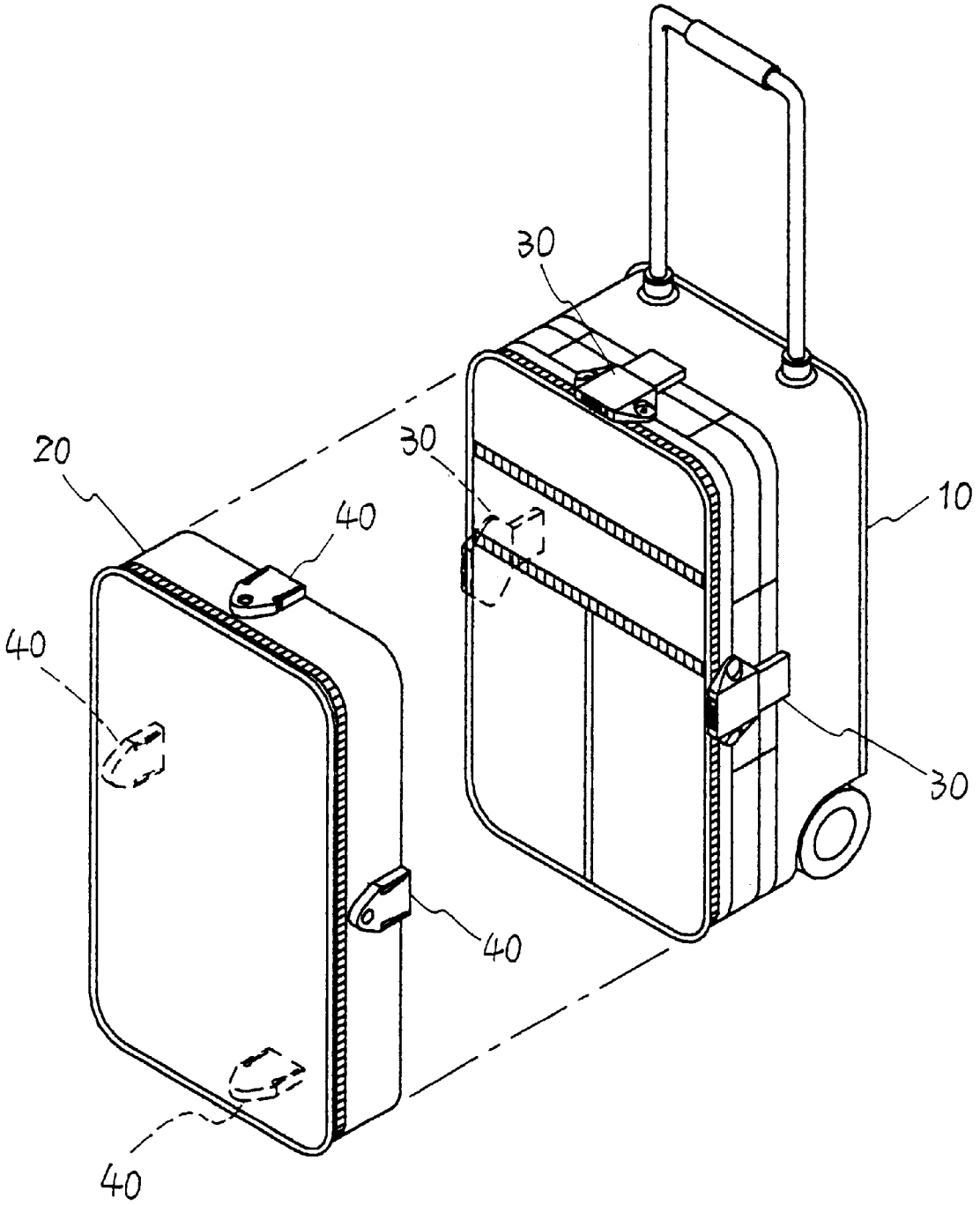
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

With reference to the drawings and in particular to FIG. 1 thereof, the luggage case according to the present invention generally comprises a primary case 10 and a secondary case 20.

The primary case 10 is a rectangular container provided with four male fasteners 30 mounted on four lateral sides thereof. All of the male fasteners 30 are positioned close to the front side of the primary case 10. The secondary case 20 is also a rectangular container and smaller than the primary case 10 in size. The secondary case 20 is provided with four female fasteners 40 at the upper, lower and two lateral sides thereof which are disposed close the inner side of the secondary case 20 and adapted to engage with the male fasteners 30.

Figure 2A:
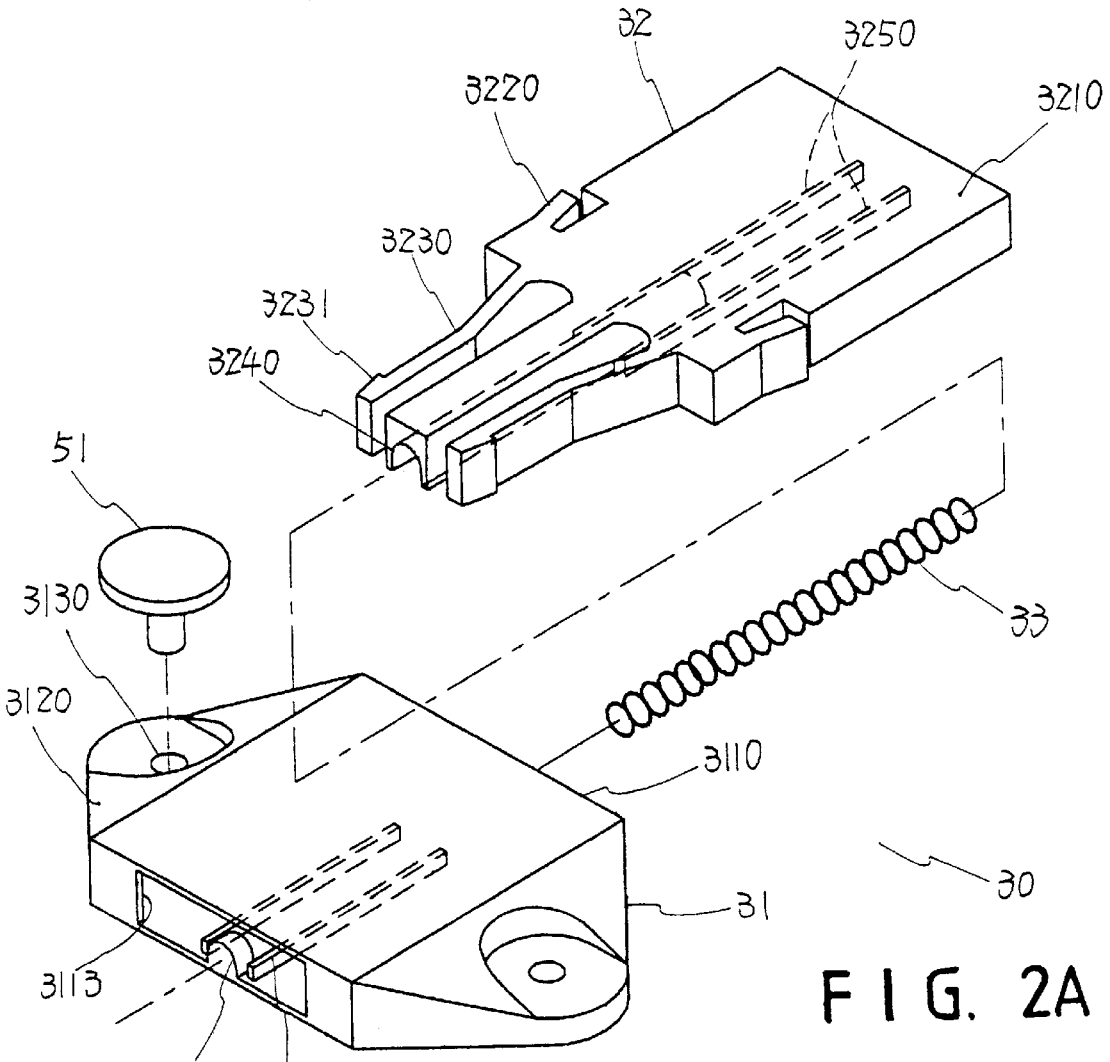
FIG. 2A is an exploded view of the plug.
Figure 3:
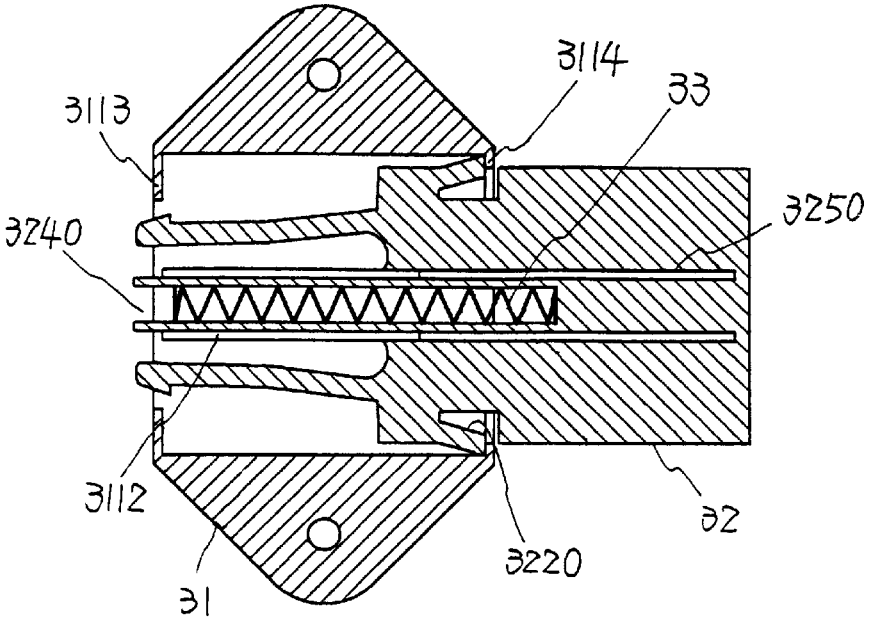
FIG. 3 is a sectional view of the male fastener.

As shown in FIGS. 2A and 3, the male fastener 30 includes a base 31 formed with a rectangular passage 330 going therethrough for receiving a plug 32. The base 31 has two flanges 31 at two opposite ends each formed with a hole 3130 through which a rivet 51 extends into the primary case 10 to secure the base 31 on the primary case 10. The rectangular passage 3110 is provided with two longitudinal projections 3112 at the intermediate portion which are parallel to each other and extend upwardly from the inner bottom of the rectangular passage 3110. A semi-circular tongue 311 is provided between the two longitudinal projections 3112 and located at the left end (with respect to FIG. 2A) of the rectangular passage 3110. The rectangular passage 3110 is formed with two first stop flanges 3113 at the left end and two second stop flanges 3114 at the right end. The plug 32 has a body portion 3210 which is longer than the base 31 and dimensioned to fit into the rectangular passage 330 of the base 31. The plug 32 is formed with two arms 3220 extending outwardly and rearwardly at two opposite sides and the distance between the two arms 3320 is slightly larger than the width of the rectangular passage 330 of the base 31 so that when the plug 32 is inserted into the rectangular passage 330 of the base 31, the two arms 330 of the plug 32 will first move inwardly to go over the second stop flanges 3114 of the rectangular passage 330 and then return to their original positions thereby preventing the plug 32 to go out of the base 31. The left end of the plug 32 has two positioning legs 3230 and a guiding leg 3200 between the two positioning legs 3230. The outer end of each of the positioning legs 3230 has a hook end 3231. The bottom of the guiding leg 3200 is formed with a semi-circular elongated groove 3240 dimensioned to receive the semi-circular tongue 3111 of the base 31. A spring 33 is fitted within the semi-circular groove 3240 of the guiding leg 3200. The bottom of the plug 32 has two parallel elongated slots 3250 dimensioned to receive the two longitudial projections 3112 of the base 31.

Figure 2B:
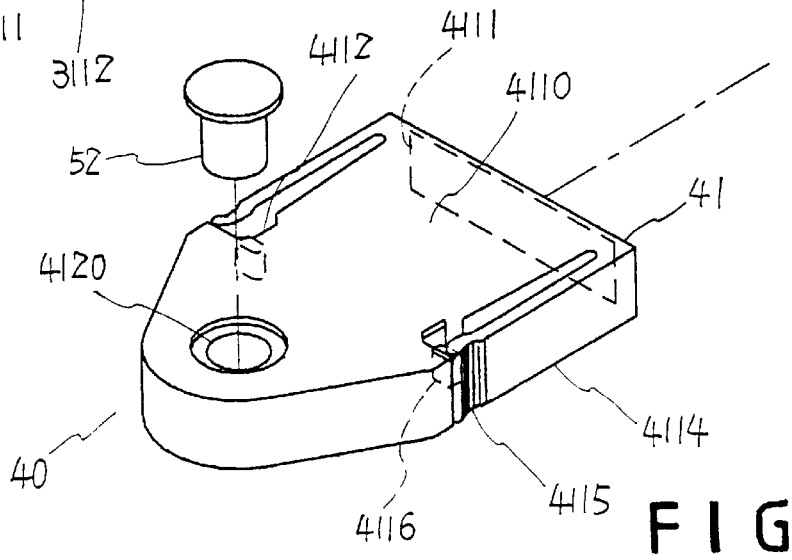
FIG. 2B is a perspective view of the base.
Figure 4:
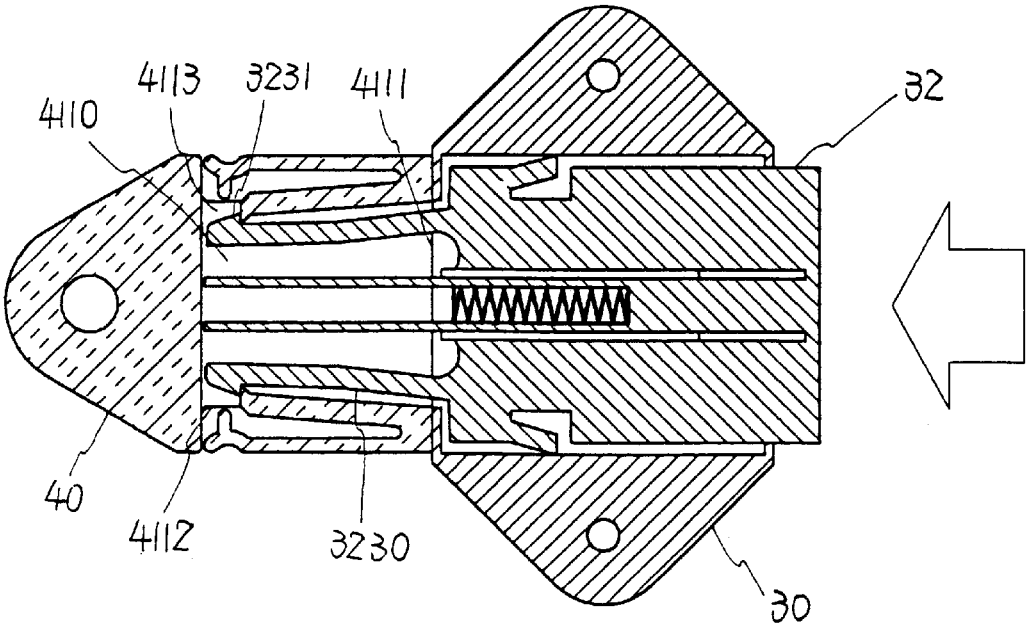
FIG. 4 is a sectional view illustrating the engagement between the male and female fasteners.
Figure 5:
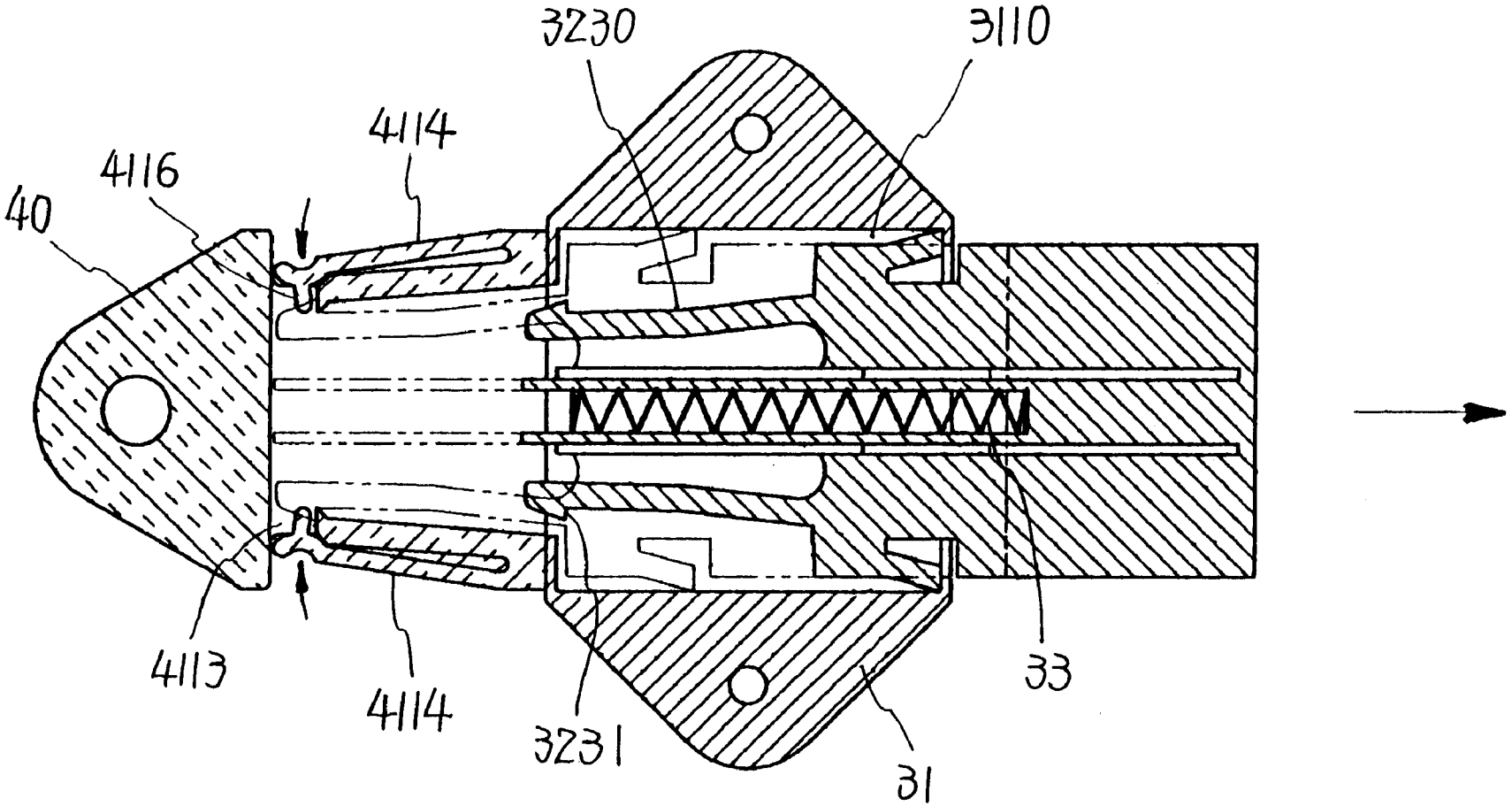
FIG. 5 is a sectional view illustrating how to disengage the male fastener from the female fastener.

Referring to FIGS. 2B, 4 and 5, the female fastener 40 includes a body 41 formed with a recess 4110 having an opening 4111 for receiving the plug 32. The left end of the female fastener 40 (with respect to FIG. 2B) has a hole 4120 through which a rivet 52 extends into the secondary case 20 to secure the female fastener 40 on the secondary case 20. The female fastener 40 has a neck 4112 having a width less than the distance between the two hook ends 3231 of the two positioning legs 3230. The neck 4112 is formed with two opposite holes 4113 for receiving the hook ends 3231 of the two positioning legs 3230. The female fastener 40 is provided at two oppposite sides with two positioning arms 4114 each having a protuberance 4116 at the outer end adapted to engage with respective hole 4113.

Figure 6:
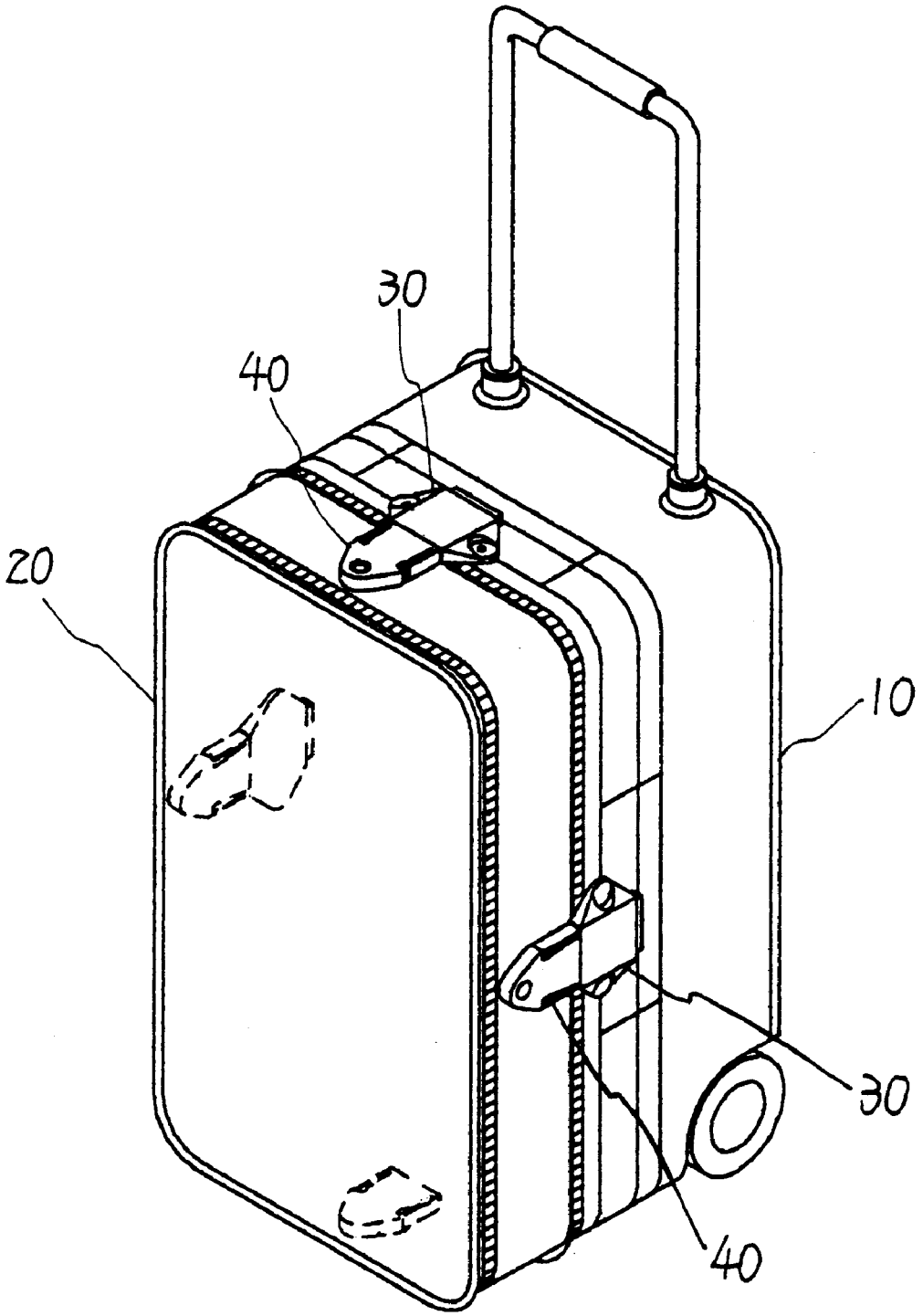
FIG. 6 is a perspective view of the present invention.
Figure 7:
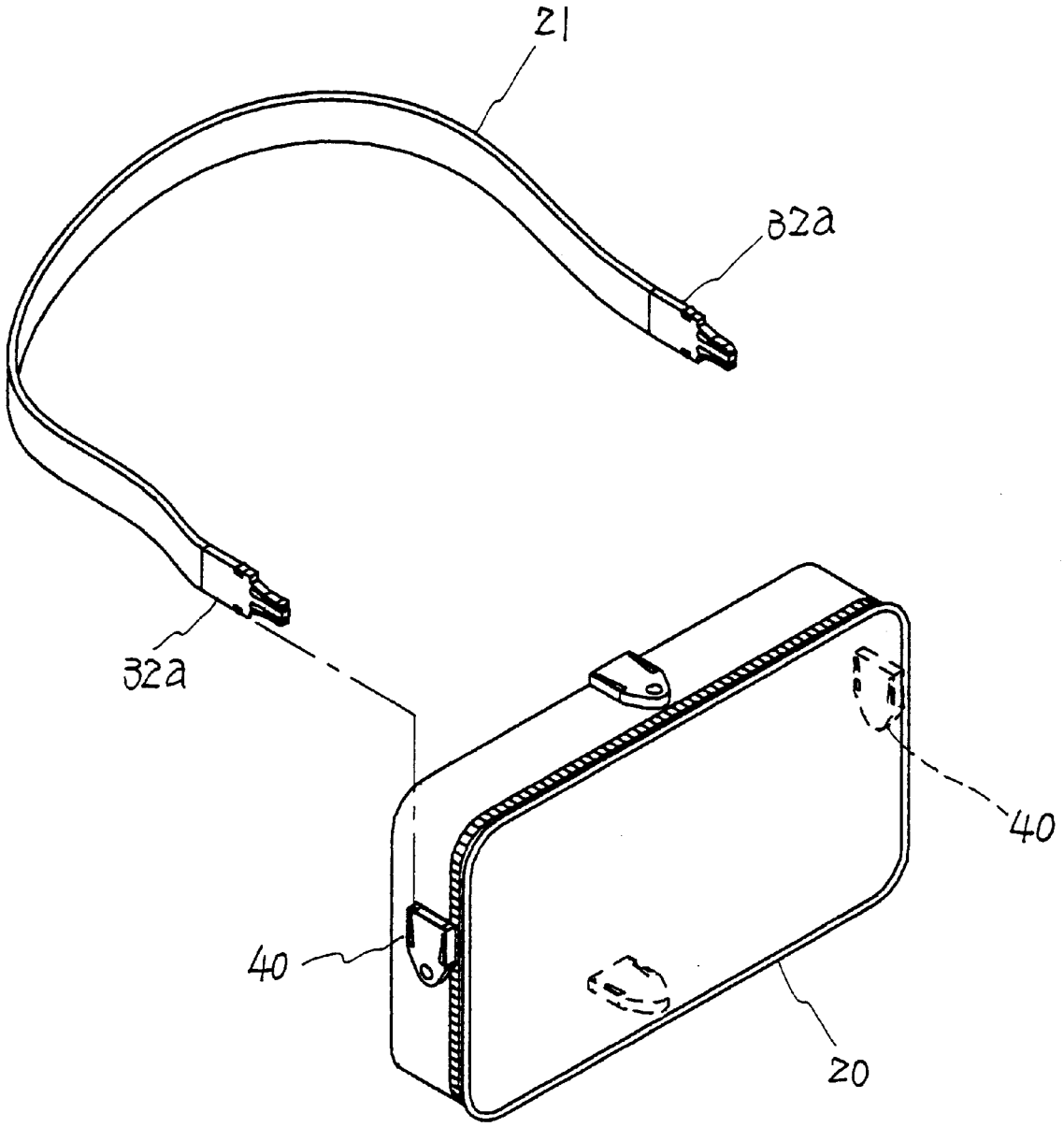
FIG. 7 illustrates how to use a strap to connect with the secondary case.

As the plug 32 is inserted into the base 31, the two arms 330 of the plug 32 will first move inwardly to go over the second stop flanges 3114 of the rectangular passage 330 and then return to their original positions thereby preventing the plug 32 to go out of the base 31. In the meantime, the spring 33 will push the plug 32 to go backwardly thereby urging the arms 330 of the plug 32 against the second stop flanges 3114 of the base 31 (see FIG. 3). When desired to engage the primary case 10 with the second case 20, it is only necessary to push the plug 32 from the rear end so that the arms 3230 of the plug 32 are pushed into the recess 4110 of the female fastener 40 through the opening 4111 thereby engaging the hook ends 3231 of the arms 3230 with the holes 4113 of the female fastener 20 and therefore engaging the primary case 10 with the secondary case 20 (see FIG. 6).

When desired to disengage the male fastener 10 from the female fastener 20, simply depress the positioning arms 4114 inwardly to push the hook ends 3231 of the arms 3230 of the plug 32 out of the holes 4113 of the female fastener 20. Then, the spring 33 will force the plug 32 to move away from the female fastener 20 thus disengaging the male fastener 10 from the female fastener 20 (see FIG. 5).

Furthermore, a strap 21 with two male fasteners 32*a* which are of the same structure as the male fastener 32 is provided for connecting with the female fasteners 40 of the secondary case 20 so that when the secondary case 20 is disengaged from the primary case 10, the secondary case 20 can be conveniently carried on the shoulder with the strap 21.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A luggage case comprising:

a primary case provided with a plurality of male fasteners each including a base and a plug, said base being riveted on said base and having a passage going through said primary case and two first stop flanges extending inwardly at an end of said passage and two second stop flanges extending inwardly at another end of said passage, said plug having two positioning legs extending from an end of said plug and each having a hook at an end thereof, a guiding leg extending from said end of said plug and located between said two positioning legs, and two arms extending outwardly from two sides of said plug and each having an end pointing another end of said plug, distance between said two arms being larger than distance between said two second stop flanges, said plug being fitted within said passage of said base;

a secondary case provided with a plurality of female fasteners riveted on said secondary case, each of said female fasteners having a recess adapted to receive said plug, a neck portion having two holes at two opposite sides thereof, and two positioning arms at said two opposite sides thereof each having a protuberance engageable with said holes of said neck portion.

2. The luggage case as claimed in claim 1, wherein said guiding leg has a groove open at an outer end thereof in which is fitted a spring.

3. The luggage case as claimed in claim 1, wherein said passage of said base has a tongue dimensioned to fit into said groove of said guiding leg for preventing said spring from going out of said groove.

4. The luggage case as claimed in claim 1, further comprising a strap provided with two male fasteners at two opposite ends thereof.

* * * * *